US008156716B2

(12) United States Patent
Deckert

(10) Patent No.: US 8,156,716 B2
(45) Date of Patent: Apr. 17, 2012

(54) BEVERAGE BOTTLING OR CONTAINER FILLING PLANT HAVING A BEVERAGE BOTTLE OR CONTAINER LABELING MACHINE, AND A BEVERAGE BOTTLE OR CONTAINER LABELING MACHINE HAVING A VACUUM DRUM

(75) Inventor: Lutz Deckert, Haltern am See (DE)

(73) Assignee: KHS AG, Dortmund (DE)

( * ) Notice: Subject to any disclaimer, the term of this patent is extended or adjusted under 35 U.S.C. 154(b) by 280 days.

(21) Appl. No.: 12/432,491

(22) Filed: Apr. 29, 2009

(65) Prior Publication Data

US 2009/0260712 A1 Oct. 22, 2009

Related U.S. Application Data

(63) Continuation-in-part of application No. PCT/EP2007/009370, filed on Oct. 29, 2007.

(30) Foreign Application Priority Data

Oct. 31, 2006 (DE) ..... 10 2006 051 898

(51) Int. Cl.
*B65B 61/00* (2006.01)

(52) U.S. Cl. ..... 53/135.1; 53/411

(58) Field of Classification Search ..... 53/411, 53/410, 167, 485, 135.1, 136.1, 268, 287
See application file for complete search history.

(56) References Cited

U.S. PATENT DOCUMENTS

| | | | | |
|---|---|---|---|---|
| 2,525,741 | A | 10/1950 | Von Hofe et al. | |
| 2,668,632 | A | 2/1954 | Zimpel | |
| 3,563,377 | A | 2/1971 | Southcott | |
| 4,574,020 | A * | 3/1986 | Fosnaught | 156/80 |

(Continued)

FOREIGN PATENT DOCUMENTS

| | | |
|---|---|---|
| DE | 1 556 624 | 2/1970 |

(Continued)

OTHER PUBLICATIONS

English translation of International Preliminary Report on Patentability PCT/EP2007/009370.

*Primary Examiner* — Paul Durand
(74) *Attorney, Agent, or Firm* — Nils H. Ljungman & Associates

(57) ABSTRACT

Beverage bottling or container filling plant having a beverage bottle or container labeling machine, and a beverage bottle or container labeling machine having a vacuum drum. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

20 Claims, 6 Drawing Sheets

U.S. PATENT DOCUMENTS

| | | | | |
|---|---|---|---|---|
| 4,662,965 | A * | 5/1987 | DiFrank et al. | 156/215 |
| 5,021,111 | A | 6/1991 | Swenson | |
| 5,116,452 | A * | 5/1992 | Eder | 156/566 |
| 5,779,835 | A * | 7/1998 | Rello et al. | 156/187 |
| 5,863,382 | A * | 1/1999 | Hinton | 156/510 |
| 5,964,974 | A * | 10/1999 | Hinton | 156/215 |
| 6,328,832 | B1 * | 12/2001 | Otruba et al. | 156/64 |
| 6,471,802 | B1 | 10/2002 | Williamson | |

FOREIGN PATENT DOCUMENTS

| | | |
|---|---|---|
| DE | 689 03 083 | 4/1993 |
| DE | 699 28 019 | 7/2006 |
| DE | 20 2006 011787 | 9/2006 |
| JP | 2002-002643 | 1/2002 |
| WO | WO 99/03738 | 1/1999 |
| WO | WO 01/17858 | 3/2001 |

* cited by examiner

BEVERAGE BOTTLING OR CONTAINER FILLING PLANT HAVING A BEVERAGE BOTTLE OR CONTAINER LABELING MACHINE, AND A BEVERAGE BOTTLE OR CONTAINER LABELING MACHINE HAVING A VACUUM DRUM

CONTINUING APPLICATION DATA

This application is a Continuation-In-Part application of International Patent Application No. PCT/EP2007/009370, filed on Oct. 29, 2007, which claims priority from Federal Republic of Germany Patent Application No. 10 2006 051 989.5, filed on Oct. 31, 2006. International Patent Application No. PCT/EP2007/009370 was pending as of the filing date of this application. The United States was an elected state in International Patent Application No. PCT/EP2007/009370.

BACKGROUND

1. Technical Field

The present application relates to a vacuum drum for the use in container treatment machines, in one possible embodiment labeling machines, with a drum element that is journaled for rotation in a carrier arrangement and that is configured to be powered for rotation about a drum axis. The vacuum drum also comprises at least one vacuum channel that is configured in the drum element and opens into a vacuum opening, as well as comprises a rotary distributor or vacuum distributor for connecting the at least one vacuum canal configured in the drum element with a vacuum source. The rotary distributor or vacuum distributor comprises at least one first sealing surface at a first distributor element that does not rotate with the drum element, as well as at least one second sealing surface provided at the drum element for a sealing position against the first sealing surface.

2. Background Information

Background information is for informational purposes only and does not necessarily admit that subsequently mentioned information and publications are prior art.

Vacuum drums for use in container treatment machines, in one possible embodiment labeling machines, are known and serve, for example, as transport drums for the advancing, or forwarding of labels and/or, respectively, are a component, as cutting drums, of a cutting arrangement of an labels aggregate for processing of endless labels or label material. During operation the respective vacuum drum is constantly or substantially constantly or intermittently operated under vacuum, by way of a rotary distributor, or vacuum distributor. Furthermore, the rotary distributor and vacuum distributor comprises at least two sealing surfaces, namely a first sealing surface which is arranged at a distributor element that does not rotate with the vacuum drum, or, respectively, does not rotate with the drum element; and the rotary distributor and vacuum distributor comprises a second sealing surface which rotates with the drum element, or, respectively, is provided at the drum element. Both sealing surfaces lie mutually close together, for example, due to the force that is generated by a spring arrangement. In the case of known vacuum drums the sealing surface intended at the drum element is formed by a surface of the drum element that is basically made of metal, while the distributor element that does not rotate with the drum element of the rotary distributor, or vacuum distributor just as the sealing surface provided at this distributor element, is made of plastic, or synthetic material so as to reduce friction losses by using this composite material comprising metal and plastic, or synthetic material.

However, this arrangement has the disadvantage that friction losses cannot substantially be avoided, restricted, and/or minimized and the resulting frictional heat flows directly into the drum element made of the metallic material, so that the drum element is heated during the operation to a considerable extent, while there does not arise, through the plastic, or synthetic material of the drum element of the rotary distributor, or vacuum distributor, that does not rotate with the drum element, an appreciable heat reduction, inasmuch as in comparison to the metallic material, the plastic, or synthetic material does not reduce the frictional heat, or in a very low amount. For this reason it is often usual and necessary or desired to cool the drum element with a chilling medium, e.g., with water, oil, or an air pressure which causes an additional constructive expenditure.

The warming, or heating, or, possibly, overheating of the drum element leads to the fact that there arise operational changes, for example, changes of the diameter of this drum element which changes impair the operation of the vacuum drum. In one possible embodiment, when the vacuum drum is configured to operate as a cutting drum of a cutting arrangement, the frictional heat that is introduced into the drum element leads to changes of the cutting gap which has negative consequences with respect to the quality of the cut and/or the processing speed.

To avoid, restrict, and/or minimize these disadvantages, embodiments have become known in which the drum element is actively subjected to heat, so as to maintain the drum element independent of working conditions constantly or substantially constantly or intermittently at a certain temperature, from which results that the dimensional relations in the cutting gap are not varied and the quality of the cut is influenced merely by the operational settings. Disadvantageously in such devices are the substantially constructive and apparatus-related expenditures and the high energy costs caused by the heating.

OBJECT OR OBJECTS

A task or object of the present application is to indicate a vacuum drum which avoids, restricts, and/or minimizes these disadvantages. For the solution of this task a vacuum drum is configured as a vacuum drum for the use in container treatment machines, in one possible embodiment labeling machines, comprising a drum element that is journaled for rotation in a carrier arrangement and that is configured to be powered for rotation about a drum axis. The vacuum drum also comprises at least one vacuum channel that is configured in the drum element and opens into a vacuum opening, as well as with a rotary distributor or vacuum distributor for connecting the at least one vacuum canal configured in the drum element with a vacuum source. The rotary distributor or vacuum distributor comprises at least one first sealing surface at a first distributor element that does not rotate with the drum element, as well as comprises at least one second sealing surface provided at the drum element for a sealing position against the first sealing surface. The first distributor element which forms the first sealing surface is made of a first material of construction which has a higher heat conductivity than a second material of which is made the second sealing surface of a portion at the drum element.

SUMMARY

In accordance with the present application the distributor element, that does not rotate with the drum element, meaning that also the "first" sealing surface at this distributor element does not rotate with the drum element, is configured of a material which exhibits a substantially higher heat conductivity when compared to the material of the second sealing surface at the drum element that rotates. Thus, the distributor element of the rotary distributor and vacuum distributor that does not rotate with the drum element, operates as a heat sink, by means of which the frictional heat of the rotary distributor and vacuum distributor is removed. The material forming the second sealing surface at the drum element that rotates, furthermore, also serves as a heat barrier, so that alone by these measures a heating, at least an excessive heating, of the rotating drum element of the vacuum drum, which element is made otherwise from a metallic material, is substantially avoided, restricted, and/or minimized. The cooling, or chilling effect can be further enhanced by a suitable cooling, for example, by chilling ribs in the distributor element that does not rotate with the drum element of the rotary distributor, or vacuum distributor.

In other words, the vacuum or rotary distributor has two parts which are a first distributor element that rotates along with the vacuum drum, and a second distributor element that is stationary. The stationary second distributor element is made out of a material that has a higher heat conductivity than that of the vacuum drum. Since this second distributor element has a higher heat conductivity than the vacuum drum, it could act as a heat sink to draw the heat away from the vacuum drum. Chilling ribs located in the second distributor may serve to help dissipate heat generated by the vacuum drum, and enhance the cooling of the vacuum drum. The first distributor element rotates with the vacuum drum. This first distributor element is made out of a non-metallic material, or a material of a low heat conductivity, so that this distributor element could serve as a heat barrier or shield.

In one possible embodiment of the present application an active cooling of the distributor element that does not rotate with the drum element occurs by means of a cooling medium that is passed about and/or, respectively, through the distributor element that does not rotate with the drum element, for example, a steam-like and/or, respectively, a gas-like cooling medium (e.g., chilling air) and/or, respectively, a liquid chilling medium.

In other words, in on possible embodiment of the present application, a cooling medium that is cycled through the part of the distributor element functioning as a heat sink could be steam-like, gas-like (such as chilling air), and/or a liquid chilling medium.

The "second" sealing surface provided at the drum element that is rotating is formed, for example, by an exchangeable distributor element. Then this distributor element could comprise at least two parts, or segments, so that through this two-component configuration a simple exchange of the distributor element that is forming the second sealing surface is possible.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Further embodiments are described according to the present application. The present application is explained further in the following with the aid of the figures which illustrate an embodiment. There is shown in.

DESCRIPTION OF EMBODIMENT OR EMBODIMENTS

Figure 1:
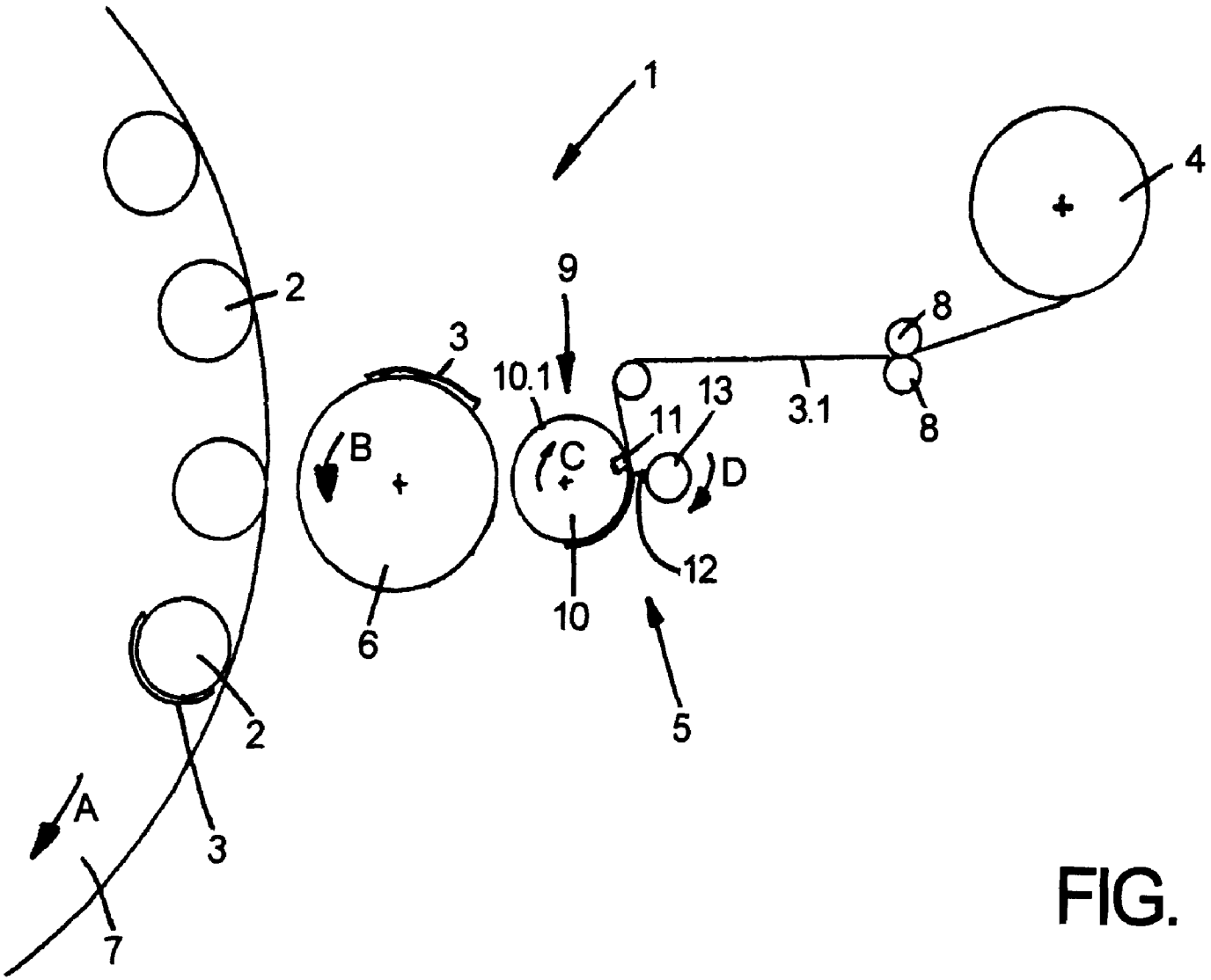
FIG. 1 in schematic and top plan view the labeling arrangement of a labeling machine for labeling of containers with so-called Roll-Fed labels.

In the figures a labeling arrangement 1 is configured to operate with a labeling machine for labeling of bottles, or such like containers 2 with so-called Roll-Fed labels 3 which are drawn off from a stock roller 4 of an endless, tape-shaped label material 3.1; and the labels 3 are cut off in a cutting arrangement 5 of the labeling arrangement 1 with the respective length that is required and/or desired for a label 3, from the label material 3.1. The labels 3 established in this manner are passed, by means of a labeling drum and transfer drum 6, onto the containers 2 which are moving there along on a rotor 7 that is rotating about a vertical machine axis of the labeling machine in the labeling arrangement 1; and the labels 3 are secured to the containers 2. The rotation directions of the rotor 7 and of the transfer drum 6 are respectively indicated by the arrows A or B.

In other words, in one possible embodiment, FIG. 1 depicts a labeling arrangement 1. Labeling arrangement 1 is configured to apply labels to a container, which may be a bottle 2. Prior to being cut to a predetermined size, the labels 3 are in a tape like roll of label material 3.1 which is drawn from a stock roller 4. The label material 3.1 is cut to a predetermined label 3 length in the cutting arrangement 5. The labels are passed by means of the transfer drum 6, which rotates in a counterclockwise direction B. The bottles 2 move along the rotor 7 in a clockwise direction A, and the labels are a applied to the surface of the bottles 2 upon coming into contact with one another.

The label material 3.1 is drawn off from the stock roller 4 by means of conveyer rollers 8 that are synchronically operated with the rotary movement of the rotor 7 and the labels material 3 is supplied to the cutting arrangement 5. This comprises, among other things, a cutting drum, or vacuum drum 9 which during labeling is powered, or, respectively, its drum element 10 is powered so as to rotate about its vertical drum axis; namely in the direction of rotation that is directed oppositely with respect to the direction of rotation of the transfer drum 6 (arrow C). At the circular-cylindrical, circumferential surface 10.1 the drum element 10 comprises at least one cutting drum knife 11 which is oriented with its edge parallel or substantially parallel with respect to the drum axis of the vacuum drum 9; and to this knife 11 there is assigned a counter knife 12 that is secured in a knife shaft 13, so that upon every full rotation of the drum element 10, by means of the co-operation, or co-action, of the drum knife 11 and the counter knife 12, there will be severed a label 3, having the predetermined length, from the label material 3.1, which severed label is temporarily held by vacuum on the circumferential surface 10.1 of the drum element 10 and is then passed to the transfer drum 6.

Figure 1A:
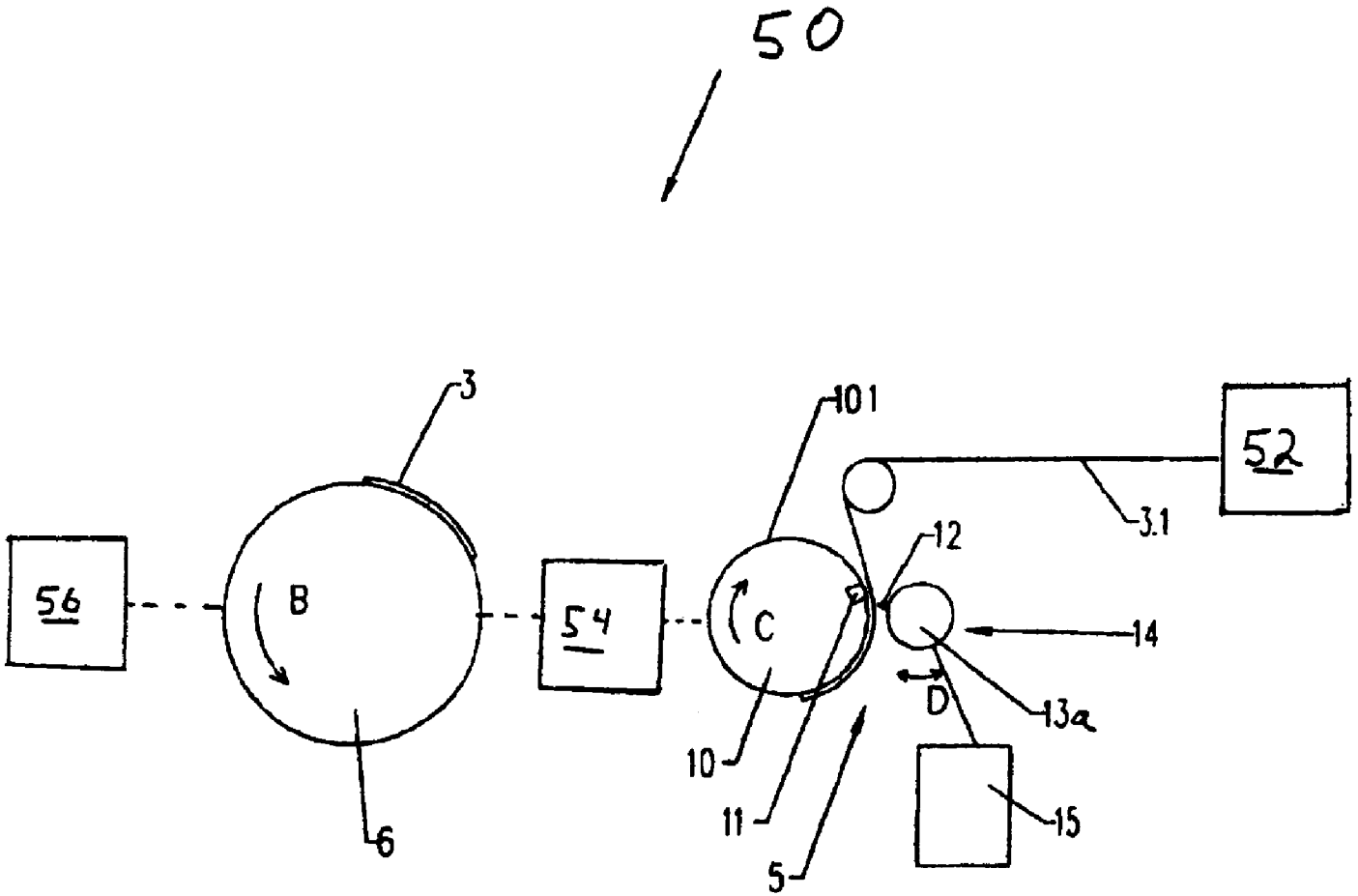
FIG. 1A shows a schematic plan view of an alternative embodiment of a labeling device.

In one possible embodiment, FIG. 1A shows a labeling machine 50 comprising a label supply and feeding arrangement 52 configured to supply and feed uncut labels to a cutting station. The cutting station comprises a rotatable vacuum drum 10 with a plurality of vacuum openings in an outer circumferential surface thereof configured to be in flow communication with a vacuum source, not shown. At least one anvil 11 is disposed on vacuum drum 10 and longitudinally extends parallel to the axis of rotation of vacuum drum 10. A cutting arrangement comprises a knife carrier cylinder 13*a* comprising a supporting axle and at least one knife 12 radially extending from knife carrier cylinder 13*a*. The axle has an axis of rotation substantially parallel with the axis of rotation of vacuum drum 10 and is configured to provide angular movement of the at least one knife 12. Knife 12, radially extending away from the axle of knife carrier cylinder 13*a* has an axial length substantially equal to the axial length of each of the at least one anvil 11. Knife 12 is configured to be stationary during label cutting and to cooperate each anvil 11, to cut uncut labels in strip form 3.1 into individual labels 3.

Figure 2:
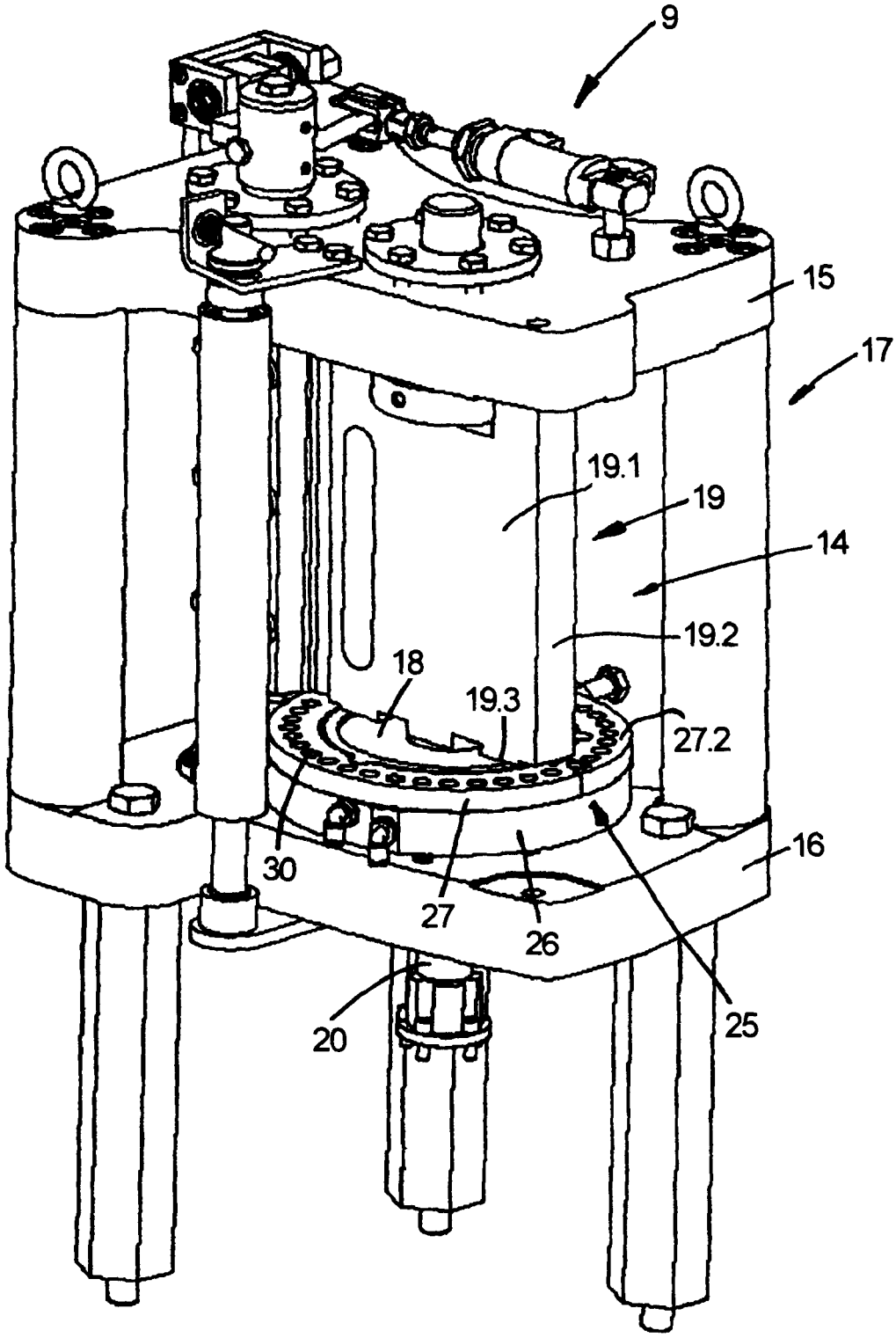
FIG. 2 in perspective, partial representation the cutting arrangements of the labeling arrangement of the labeling machine in accordance with FIG. 1, together with parts of the vacuum drum, or cutting drum.

A transmission 15 is connected to the axle of knife carrier cylinder 13*a* and is configured to rotate the axle and knife 12 to initially position knife 12 in a position to sufficiently align it with anvils 11 to permit adjustment of the position knife 12 with an adjusting means, shown in FIGS. 2 and 2A, with respect to anvils 11.

Block 54 designates a label transfer device configured to transfer cut labels 3 from vacuum drum 10 to transfer drum 6. The label transfer device may be grippers or may transfer labels 3 by way of varying the pressure within vacuum drums 10 and 6, at a point of transfer designated by box 54. Other transfer devices as are known in the art may be used to transfer labels from vacuum drum 10 to transfer drum 6.

Cut labels 3 are transferred from transfer drum 6 and placed onto containers at block 56. The labels 3 may be glued onto containers or the labels 3 may have a backing removed from an adhesive material on labels 3. Brushes may be used to apply pressure to labels 3 upon placing them onto containers. Other means for applying labels to containers as are known in the art may be used to affix labels 3 to containers.

FIGS. 2 through 5 show in greater detail the vacuum drum 9. This drum comprises, among other things, a drum carrier, or bearer 14 that is a part of the drum element 10 and that is disposed and connected, so as to be able to rotate around the vertical axis, to an upper board, or plate member 15 and to a lower board or plate member 16 of a carrier arrangement 17. The drum bearer 14 as such comprises an upper and a lower disc-shaped, or plate-like carrier element 18 and a spacer structure, or distance structure, or carrier structure 19 being configured to provide a wall, or wall surface; and the carrier structure 19 is connected to a drive shaft 20 of the drum element 10 in such a way that the axis of the drive shaft 20 is disposed substantially centrally with respect to the two larger surface sides 19.1 of the wall-like distance structure 19; and these surface sides 19.1 of the distance structure, or distance piece 19 are disposed at equal distances from the axis of the shaft 20. Also, the narrower surface sides 19.2 of the wall-like distance piece 19 are disposed to lie in parallel or virtually parallel with the axis of the shaft 20 and in the shown embodiment are disposed in each case the same distance away from this axis. The upper plate-like carrier element, as well as the lower plate-like carrier element 18 are connected to the side, or surface 19.3 of the distance structure 19; this side, or surface 19.3 being a lower, or, respectively, upper side, respectively radially in reference to the axis of the shaft 20. At the drum bearer 14 there are provided, between the upper and lower plate-like carrier elements 18, several segments 21 which provide the circular-cylindrical, circumferential surface 10.1 of the drum element 10. Furthermore, concerning their configuration, the segments 21 are partial segments of a wall of a hollow cylinder, or they are configured to establish the outline of a hollow cylinder; and the segments 21 have in each case vacuum canals 22 which terminate with vacuum openings 23 in the exterior surface of the segments 21 which configure the exterior surface, or circumferential surface 10.1 of the drum element 10. At a narrow side 19.2 of the distance structure 19 is fastened a bar, or structure 24 which carries the knife 11. In exterior relationship with the knife bar structure 24, the entire circumferential surface 10.1 is formed by segments 21 which are contiguously associated with, or adjacent to the knife bar structure 24 as well as also being contiguously associated with, or adjacent to each other.

So as to connect the vacuum canals 22 in the segments 21 to an external vacuum source, there is provided a rotary distributor 25, which comprises in this embodiment a vacuum distributor, or rotary distributor element 26, which is essentially shaped as a ring and which concentrically surrounds the drive shaft 20; the rotary distributor 25, furthermore, comprises at the side, or surface of the drum, i.e., intended to be disposed at the lower disc-like carrier 18, a likewise ring-shaped distributor elements 27. By way of several compression springs 28, disposed between the lower plate structure, or board 16 and the underside of the distributor element 26, the distributor element 26 that is disposed so as not to rotate with the drum element 10, is in operative contact with an upper ring or sealing surface 26.1 against a lower ring or sealing surface 27.1 of the distributor element 27. Both sealing surfaces 26.1 and 27.1 are configured in each case to be substantially flat and extend in a level vertically with respect to the axis of the drive shaft 20.

Figure 3:
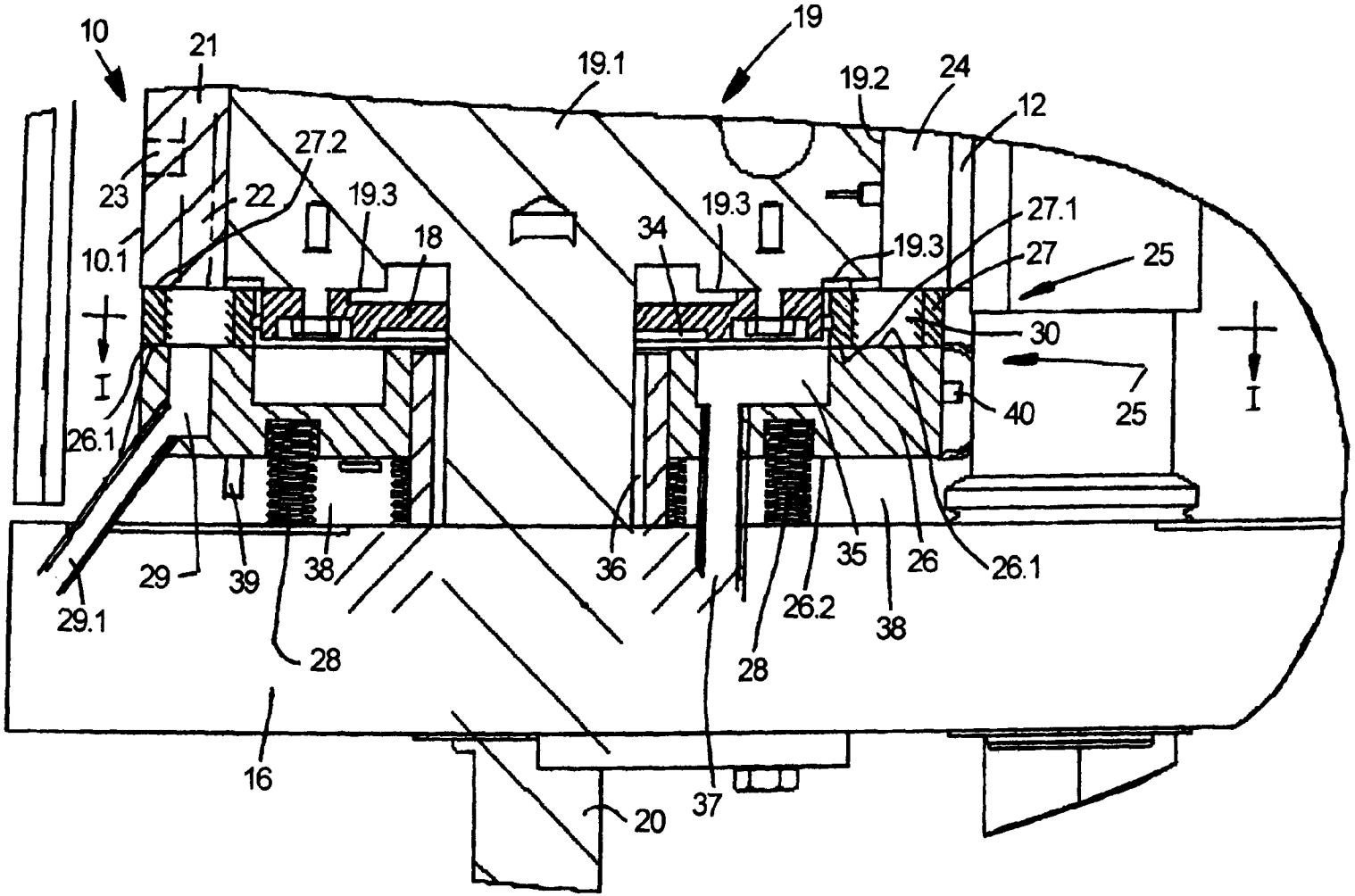
FIG. 3 a sectional view through the drum element of the vacuum drum and through the vacuum distributor.

As shown in FIG. 3, a groove-shaped vacuum canal, or channel 29 is provided, such as in the angle-area of the rotary movement of the drum element 10, in which angle-area the labels 3 are held until their transfer of being handed over to the containers 2; and this groove-shaped vacuum canal 29 is in operative communication, by means of a vacuum connection 29.1, with the external vacuum source and is, furthermore, open at the sealing surface 26.1.

The distributor element 27 is provided with a large number of openings 30 which are arranged such that in each case a connection is reached between the vacuum canal 29 and the vacuum canals 22 by these openings 30.

Figure 4:
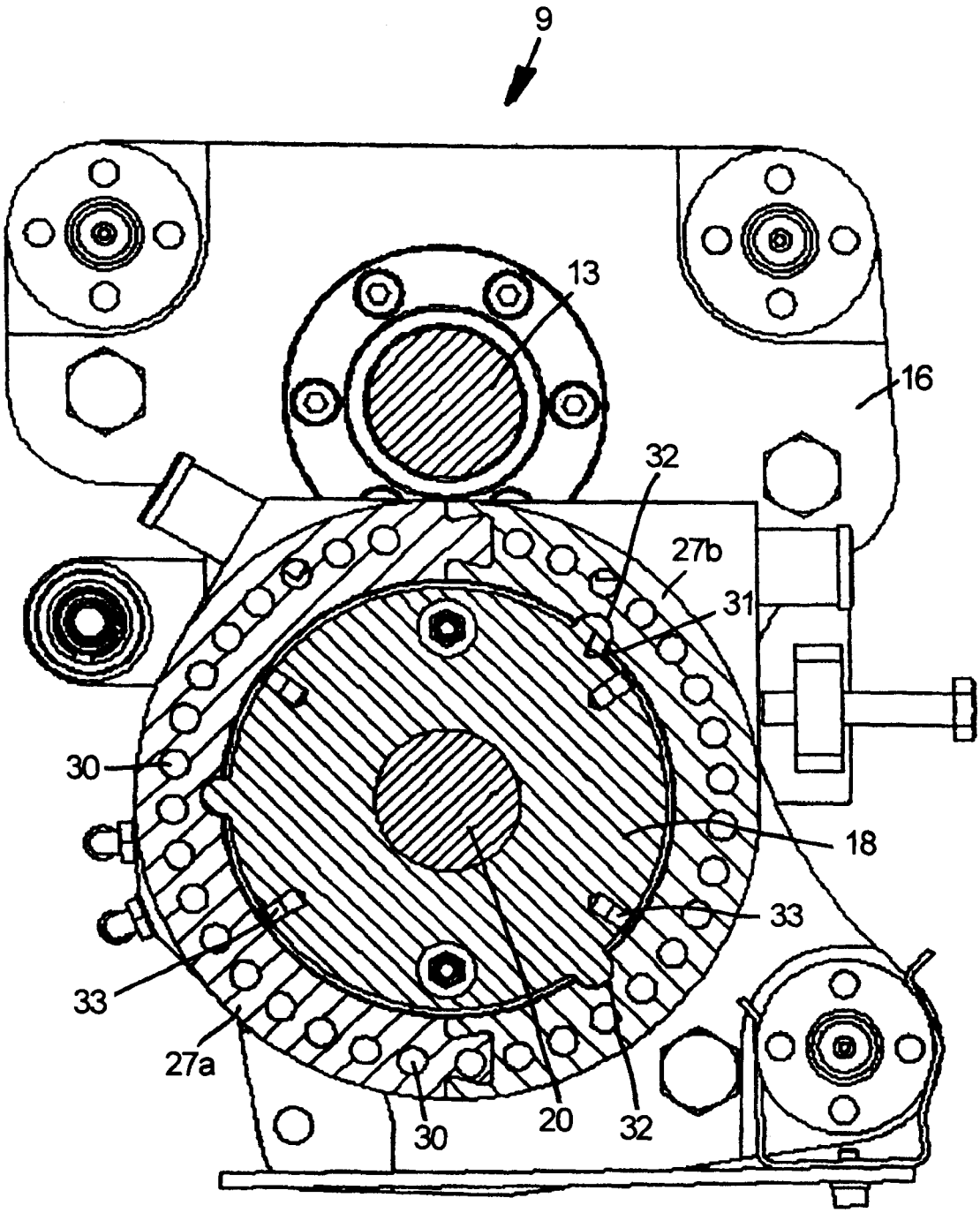
FIG. 4 sectional view according to the line I-I in FIG. 3.
Figure 5:
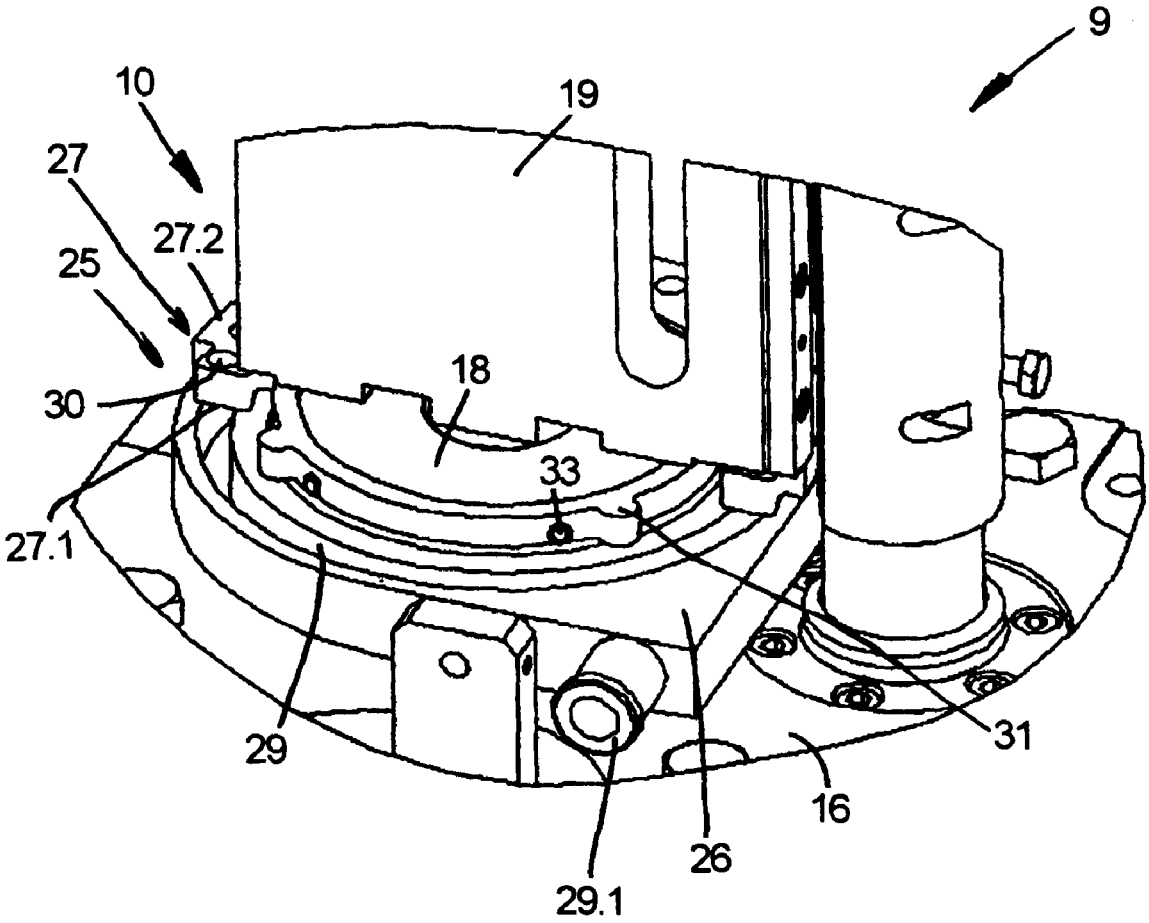
FIG. 5 in an enlarged perspective representation the lower, discs-shaped carrier element of the vacuum drum, or, respectively, the drum element that rotates, with the distributor element being shown as partially taken away.

As is illustrated in the FIGS. 2, 4 and 5, the distributor element 27 which is configured as an exchangeable wear part and in sections, i.e., this ring-shaped distributor element 27 comprises two identically shaped portions, or segments 27*a* and 27*b* which are connected at their ends by being interconnected together in operational connection with respect to each other and are complementary with respect to the ring-shaped distributor element 27 by way of this configuration. By way of noses 31 that are disposed at the dish-like carrier, or element 18, which noses 31 extend radially beyond the circumferential surface of the dish-like carriers 18 and in each case extend into recesses 32 at the inside of the distributor element 27 as well as by additional connections 33 the distributor element 27 is in one possible embodiment also connected torque-proof, or rotation-fast with the dish-like carrier 18 and with it to the drum element 10. The connections 33 are, for example, elastic elements which co-act in suitable lock-grooves which are formed at the inside of the ring-like distributor element 27.

With its upper side, or, respectively, with a flat, annular surface, or sealing surface 27.2 that is provided there, the distributor element 27 lies sealingly close against the underside of the drum segments 21, so close that by means of the rotary distributor, or vacuum distributor 25 an operative vacuum connection to the vacuum canals 22 is maintained in the segments 21.

In other words, as shown in FIG. 3, the upperside of sealing surface 27.2 maintains a tight seal, or substantially tight seal with the underside of the drum segments 21. The tight seal could aid in the maintaining of a vacuum generated by the vacuum distributor 25. This vacuum is transferred to the vacuum canals 22, and is maintained in the drum segments 21.

As is shown in FIG. 3, the distributor element 27, also referred to as second distributor element 27, is configured in such a way that it projects with its underside, or, respectively, with the ring surface, or sealing surface 27.1 beyond the underside, in one possible embodiment also the underside of the dish-like carrier 18, so that the distributor element 26 lies close exclusively against the distributor element 27 and there is formed a gap 34 between the underside of the dish-like carrier 18 and the upper side of the distributor element 26. This gap 34 is in communication with a canal 35 which concentrically surrounds the axis of the drive shaft 20 and which canal 35 is formed in the distributor element 26; with the gap 34 moreover being operatively in communication with a canal 36 (ring gaps, or annular grooves). The channel 35 comprises an open channel that is open at the upper side of the distributor element 26, which upper side of the distributor element 26 is facing toward the dish-like carrier 18; and the open channel 35 is connected, by way of a connection 37, with a source of a gaseous chilling medium, for example, chilling, or cooling air. The gap 34 and the canals 35 and 36 form a current path, or passageway arrangement for a cooling, or chilling medium; with the cooling medium reaching, by way of the connection 37, into the canal 35 and then is permitted to flow out of the canal 35 and the gap 34, and into the canal, or ring gap 26, under suitable cooling, in one possible embodiment of the rotary distributor, or vacuum distributor 25 and of the mutually adjoining distributor element 26 and 27; from this canal 36, for the additional cooling of the distributor element 26 at its underside 26.2, the cooling air reaches into a space 38 below the distributor element. So as to increase the cooling effort, the distributor element 26 at its underside comprises cooling ribs which are identified by reference numeral 39 in FIG. 3 and which extend into the space 38. Other chilling, or cooling ribs are provided, for example, in the circumferential surface of the distributor element 26 as is indicated in the FIG. 3 by reference numeral 40.

In other words, in one possible embodiment as depicted in FIG. 3, the first distributor element 26 is in contact with the second distributor element 27. At their areas of contact there are ring or surface seals belonging to both respective distributor elements. Surface seal 27.1 is disposed at the underside of the first distributor element 27, and surface seal 26.1 is disposed at the topside of the first distributor element 26. Distributor element 26 and distributor element 27 both surround the axis of the drive shaft 20 in a concentric manner. A gap 34 is positioned between the underside of the dish-shaped carrier element 18 and the upper side of the distributor element 26. The gap 34 is connected to a first canal 35, which is located in the distributor element 26. The first canal 35 is open at the upper side of the first distributor element 26, which faces the dish-like carrier 18. There is a second canal 36 which concentrically encases a portion of the drive shaft 20. The gap 34, first canal 35 and second canal 36 form a path or passage way for a cooling or chilling medium, or coolant. This cooling or chilling medium could be a gas or liquid. Possibly suitable examples of coolants could be water, steam, air, chilled air, helium, ethylene glycol, diethylene glycol, or propylene glycol. The cooling medium could enter the passageway made by the gap 34, first canal 35 and second canal 36 by a cooling medium connection 37. The cooling or chilling affect could reach into the space 38 below the distributor element 26 by means of cooling ribs 39. Additional cooling ribs 40 could project about the sides of the distributor element 26 as well.

The drum element 10, i.e., in one possible embodiment the dish-like carrier 18, the distance piece 19, the segments 21, the knife bar structure 24, etc. are made of a suitable metal. The distributor element 27 that forms the friction-partner for the distributor element 26 and which distributor element 27 comprises an independent, interchangeable component, is made of plastic, or synthetic, or another material which material exhibits good frictional qualities as a friction-partner for the distributor element 26, however, the distributor element 27 has a reduced heat conducting behavior. The distributor element 26 is made of metal, or another material with a high conductivity.

In other words, in one possible embodiment the dish-shaped carrier 18, the distance piece 19, the drum segments 21, and the knife bar structure 24 are made of a suitable metal or metals. Heat related expansion of the distributor element 27 could effect the quality of seal and/or vacuum upon connection with the vacuum canals 22. Therefore, a lower heat conductivity of the second distributor element 27 is desired to minimize, restrict, or inhibit expansion of the distributor element 27. The second distributor element 27 could comprise a plastic, synthetic, or other material of a lower heat conductivity than the dish-shaped carrier 18, the distance piece 19, the drum segments 21, the knife bar structure 24, and the first distributor element 26. The first distributor element 26 is made of a metal or other material that has a high level of heat conductivity.

In another possible embodiment of the present application, the first distributor element 26 functions a heat sink, or heat exchanger to dissipate heat generated from operation of the vacuum drum 9. Sometimes heat generated from the operation of a vacuum drum can cause expansion. This expansion may affect the consistency of predetermined settings. For example, as shown in FIG. 1, when vacuum drum 9 is configured as a cutting drum, the gap between the knife 11 on vacuum drum 9 and the counter knife on the knife shaft 13 may change due to heat related expansion of vacuum drum 9.

By way of the two-component configuration of the distributor element 27 exchanging of this distributor element can be done as required and/or desired without a dismantling of the vacuum drum, or, however, elements of this drum in case of desire. The exchange of the distributor element 27 can occur in an easy manner through the fact that the distributor element 26 is pressed against the force of the springs 28 in downwardly directed movement, then the distributor element 27 is drawn off, likewise in downwardly directed movement, from the dish-like carrier 18 and is removed after the parting of the two segments 27*a* and 27*b*. In the reverse, the assembly, or installation of the exchanged distributor element 27 occurs, i.e., by placing the segments 27*a* and 27*b* into the space between the lowered distributor element 26 and the drum element 10, by connecting of the segments 27*a* and 27*b*, by shifting and locking of the distributor element 27 onto the dish-like carrier 18 and by releasing the distributor element 26, so that this can make operative contact again, with its ring surface, or sealing surface 26.1 against the ring surface, or sealing surface 27.1 of the exchanged distributor element 27.

Vacuum drum for the use in container treatment machines, in one possible embodiment labeling machines, with a drum element that is journaled for rotation in a carrier arrangement and that is configured to be powered for rotation about a drum axis, with at least one vacuum channel that is configured in the drum element and opens into a vacuum opening; as well as with a rotary distributor, or vacuum distributor for connecting the at least one vacuum canal configured in the drum element with a vacuum source, whereby the rotary distributor, or vacuum distributor comprises at least one first sealing surface that is provided at the drum element, as well as a sealing surface at a distributor element that does not rotate with the drum element.

One feature or aspect of an embodiment is believed at the time of the filing of this patent application to possibly reside broadly in a vacuum drum for the use in container treatment machines, in one possible embodiment labeling machines, with a drum element 10 that is journaled for rotation in a carrier arrangement 17 and that is configured to be powered for rotation about a drum axis, with at least one vacuum channel 22 that is configured in the drum element 10 and opens into a vacuum opening 23, as well as with a rotary distributor, or vacuum distributor 25 for connecting the at least one vacuum canal 22 configured in the drum element 10 with a vacuum source, and the rotary distributor, or vacuum distributor 25 comprises at least one first sealing surface 26.1 at a first distributor element 26 that does not rotate with the drum element 10, as well as at least one second sealing surface 27.1 provided at the drum element 10 for a sealing position against the first sealing surface 26.1, wherein the first distributor element 26 which forms the first sealing surface 26.1 is made of a first material of construction which has a higher heat conductivity than a second material of which is made the second sealing surface 27.1 of a portion at the drum element 10.

Another feature or aspect of an embodiment is believed at the time of the filing of this patent application to possibly reside broadly in the vacuum drum, wherein the first distributor element 26 which comprises the first sealing surface passes 26.1 comprises as material of construction said first material, at least in the region of the first sealing surface.

Yet another feature or aspect of an embodiment is believed at the time of the filing of this patent application to possibly reside broadly in the vacuum drum, wherein the first distributor element 26 comprising the first sealing surface 26.1 is made altogether of the first material.

Still another feature or aspect of an embodiment is believed at the time of the filing of this patent application to possibly reside broadly in the vacuum drum, wherein the first material is a metallic material.

A further feature or aspect of an embodiment is believed at the time of the filing of this patent application to possibly reside broadly in the vacuum drum, wherein the second material is a plastic, or synthetic material.

Another feature or aspect of an embodiment is believed at the time of the filing of this patent application to possibly reside broadly in the vacuum drum, wherein the first and second sealing surface 26.1, 27.1 are configured in each case as a ring surface and/or cone surface concentrically surrounding the drum axis.

Yet another feature or aspect of an embodiment is believed at the time of the filing of this patent application to possibly reside broadly in the vacuum drum, wherein the rotary distributor, or vacuum distributor 25 is provided at a frontal side, for example, at the lower face side, in the event of use, of the drum element 10.

Still another feature or aspect of an embodiment is believed at the time of the filing of this patent application to possibly reside broadly in the vacuum drum, wherein the second sealing surface is formed by a second distributor element 27 made from the second material.

A further feature or aspect of an embodiment is believed at the time of the filing of this patent application to possibly reside broadly in the vacuum drum, wherein the second distributor element 27 is made of at least two parts, or segments 27*a*, 27*b*.

Another feature or aspect of an embodiment is believed at the time of the filing of this patent application to possibly reside broadly in the vacuum drum, wherein the segments 27*a*, 27*b* are form-locking, but releasable, connected to one another.

Yet another feature or aspect of an embodiment is believed at the time of the filing of this patent application to possibly reside broadly in the vacuum drum, wherein the second distributor element 27 is provided releasable, or, respectively, interchangeable at the drum element 10.

Still another feature or aspect of an embodiment is believed at the time of the filing of this patent application to possibly reside broadly in the vacuum drum, comprising means for chilling at least of the first distributor element 26, at least in the area of the first sealing surface 26.1.

A further feature or aspect of an embodiment is believed at the time of the filing of this patent application to possibly reside broadly in the vacuum drum, wherein the means for chilling are provided by at least one chilling canal 34, 35, 36, 38 through which can be passed a chilling medium, for example, a cooling medium in gaseous form, and/or steam form, and/or a liquid chilling medium.

One feature or aspect of an embodiment is believed at the time of the filing of this patent application to possibly reside broadly in the vacuum drum, wherein the chilling canal extends at least with a portion 34, 36 also into a space, or gap between the drum element 10 and the first distributor elements 26 that forms the first sealing surface 26.1.

Another feature or aspect of an embodiment is believed at the time of the filing of this patent application to possibly reside broadly in the vacuum drum, wherein the chilling canal also extends at a side that is facing away from the drum element 10 of the first distributor element 26 that forms the first sealing surface 26.1.

Yet another feature or aspect of an embodiment is believed at the time of the filing of this patent application to possibly reside broadly in the vacuum drum, comprising spring means 28 configured to press the first sealing surface 26.1 or, respectively, the first distributor element 26 forming this sealing surface 26.1 against the second sealing surface 27.1.

Still another feature or aspect of an embodiment is believed at the time of the filing of this patent application to possibly reside broadly in the vacuum drum, wherein its configuration as a drum for the transport of labels 3.

A further feature or aspect of an embodiment is believed at the time of the filing of this patent application to possibly reside broadly in the vacuum drum, wherein its configuration is as a cutting drum of a cutting arrangement 5, in one possible embodiment for separating of labels 3 from a tape-shaped label material 3.1.

The present application was described on the basis of one embodiment example. It will be appreciated that numerous changes, as well as variations are possible without departing from the scope and underlying thought of the present application.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the German Office Action dated Jun. 25, 2007, and/or cited elsewhere are hereby incorporated by reference as if set forth in their entirety herein as follows: WO 01/17858, having the title "LIGHTWEIGHT VACUUM DRUM," published on Mar. 15, 2001; WO 99/03738, having the title "TRANSFER CYLINDER FOR TRANSPORTING LABELS IN A LABELING MACHINE," published on Jan. 28, 1999; JP 2002-002643, having the following English translation of the Japanese title "ROTARY TRANSFER DRUM," published on Jan. 9, 2002; DE 1 556 624, having the following English translation of the German title "ARTICLE HANDLING APPARATUS," published on Feb. 26, 1970; DE 689 03 083, having the following English translation of the German title "APPARATUS AND METHOD FOR APPLYING HEAT-SENSITIVE ADHESIVE TAPE TO A WEB MOVING AT HIGH SPEED," published on Apr. 22, 1993; U.S. Pat. No. 2,525,741, having the title "LABEL ACTIVATING AND APPLYING APPARATUS," published Oct. 10, 1950; U.S. Pat. No. 2,668,632, having the title "LABELING MACHINE," published on Feb. 9, 1954; DE 699 28 019, having the following English translation of the German title "LABELING APPARATUS AND METHOD," published Jul. 13, 2006; and DE 20 2006 011 787, having the following English translation of the German title "TRANSPORT ROLLER FOR LABELS IN A LABELING DEVICE COMPRISES A PERIPHERAL SURFACE FORMED BY MOLDING PARTS WHICH ARE HELD BY AXIALLY TENSIONING BETWEEN A SUPPORT ELEMENT PROVIDED ON A SHAFT AND A CLAMPING OR TENSIONING ELEMENT ON THE SHAFT," published on Sep. 28, 2006.

U.S. patent application Ser. No. 12/429,427, filed on Apr. 24, 2009, having inventor(s) Lutz DECKERT, and Oliver KRESS, and title "A BEVERAGE BOTTLE OR CONTAINER LABELING DEVICE WITH A CUTTING UNIT AND CUTTING UNIT FOR A BEVERAGE BOTTLE OR CONTAINER LABELING DEVICE," and its corresponding Federal Republic of Germany Patent Application No. 10 2006 051 359.2, filed on Oct. 27, 2006, and International Patent Application No. PCT/EP2007/009216, filed on Oct. 24, 2006, having WIPO Publication No. WO 2008/049593 and inventor(s) Lutz DECKERT, and Oliver KRESS are hereby incorporated by reference as if set forth in their entirety herein.

Examples of heat sinks or heat enchanters or heat sinks may be found in the following patents, U.S. Pat. No. 7,503,382, having the title "HEAT EXCHANGER," published on Mar. 17, 2009; U.S. Pat. No. 6,948,909, having the title "FORMED DISK PLATE HEAT EXCHANGER," published Sep. 27, 2005; U.S. Pat. No. 6,466,444 having the title "HEAT SINK", published Oct. 15, 2002; and U.S. Pat. No. 7,522,422, having the title "HEAT SINK," published on Apr. 21, 2009.

Some examples of bottling systems and container filling plants, which may be used or adapted for use in at least one possible embodiment of the present may be found in the following U.S. patents assigned to the Assignee herein, namely: U.S. Pat. Nos. 4,911,285; 4,944,830; 4,950,350; 4,976,803; 4,981,547; 5,004,518; 5,017,261; 5,062,917; 5,062,918; 5,075,123; 5,078,826; 5,087,317; 5,110,402; 5,129,984; 5,167,755; 5,174,851; 5,185,053; 5,217,538; 5,227,005; 5,413,153; 5,558,138; 5,634,500; 5,713,403; 6,276,113; 6,213,169; 6,189,578; 6,192,946; 6,374,575; 6,365,054; 6,619,016; 6,474,368; 6,494,238; 6,470,922; and 6,463,964.

Some additional examples of container filling systems, valves or methods and their components which may be incorporated in an embodiment of the present invention may be found in the following U.S. Pat. Nos. 5,458,166; 5,566,695; 5,689,932; 5,732,528; 5,778,633; and 6,058,985.

Some examples of methods and apparatuses for closing bottles and containers and their components which may possibly be used or adapted for use in at least one possible embodiment of the present invention may be found in the following U.S. Pat. Nos. 5,398,485; 5,402,623; 5,419,094; 5,425,402; 5,447,246; and 5,449,080.

Some examples of rotary position sensors and rotary position indicators, components thereof, and components associated therewith, which may be utilized in accordance with the embodiments of the present invention, may be found in the following U.S. Pat. Nos. 5,396,139; 5,419,195; 5,424,632; 5,433,118; 5,442,329; and 5,444,368.

Some examples of filling machines that utilize electronic control devices to control various portions of a filling or bottling process and which may possibly be utilized in connection with the present invention may be found in the following U.S. Pat. Nos. 4,821,921; 5,056,511; 5,273,082; and 5,301,488.

Some examples of microcomputer control systems which may possibly be incorporated in an embodiment of the present invention may be found in the following U.S. Pat. Nos. 5,530,515; 5,548,774; 5,581,771; 5,610,749; 5,619,669; 5,664,199; and 5,687,345.

Some examples of sheet feeder arrangements, features of which may possibly be used or adapted for use in at least one embodiment of the present invention may be found in the following U.S. Pat. Nos. 3,942,787 and 4,522,388.

Some examples of gripper devices, features of which may possibly be used or adapted for use in at least one possible embodiment of the present invention may be found in the following U.S. Pat. Nos. 3,934,589; 5,265,868; 4,415,392; 5,527,027; 5,727,601; and 6,039,375.

Some examples of the control of various gripper systems, features of which may possibly be used or adapted for use in at least one embodiment of the present invention may be found in the following U.S. Pat. Nos. 3,929,069; 4,003,310; 4,031,824; 4,147,105; 4,582,316; and 4,905,595.

Some examples of labels that may possibly be used with a possible embodiment of the present invention may be found in the following U.S. Pat. Nos. 5,905,099; 6,391,415; and 6,391,415.

Some examples of vacuum sheet-feeder arrangements, features of which may possibly be used or adapted for use in at least one possible embodiment of the present invention may be found in the following U.S. Pat. Nos. 4,336,929; 4,579,330; 5,076,565; 5,232,213; and 6,189,883; 6,607,193. All of the foregoing U.S. patents are hereby incorporated by reference as if set forth in their entirety herein.

Some examples of blade cutting apparatus and methods that may possibly be utilized or adapted for use in at least one possible embodiment may possibly be found in the following U.S. patent application publications: No. 2003/0146943 A1, entitled "Label Printer-Cutter with Mutually Exclusive Printing and Cutting Operation"; U.S. Pat. No. 5,614,278 entitled "Strip of Separable Labels or Tags Having a Display Surface for Display of Information Thereon"; U.S. Pat. No. 4,189,337, entitled "Real Time Labeler System"; No. 2004/0226659 A1, entitled "Label Application System"; and No. 2004/0226659 A1, entitled "Label Application System".

Some examples of adhesive applicators that may possibly be utilized or possibly adapted for use in at least one possible embodiment of the present application may possibly be found in the following U.S. Pat. No. 5,700,322 issued to Fort on Dec. 23, 1997 U.S. Pat. No. 5,862,986 issued to Bolyard, Jr. et al. on Jan. 26, 1999; U.S. Pat. No. 6,076,711 issued to McGuffey on Jun. 20, 2000; U.S. Pat. No. 6,168,049 issued to Bollard, Jr. on Jan. 2, 2001; U.S. Pat. No. 6,499,631 issued to Zook on Dec. 31, 2002; and U.S. Pat. No. 6,592,281 issued to Clark et al. on Jul. 15, 2003. Some examples of self-adhesive labels that may possibly be utilized or adapted for use in at least one possible embodiment may possibly be found in the following U.S. Pat. No. 5,614,278 entitled "Strip of Separable Labels or Tags Having a Display Surface for Display of Information Thereon"; No. 2004/0157026 A1, entitled "Self-Adhesive Labels and Manufacture Thereof"; No. 2004/0028932 A1, entitled "Label Film with Improved Adhesion"; and No. 2003/0207062 A1, entitled "Laser-Cut table Multi-Layer Sheet Material".

Some examples of labeling apparatus and methods that may possibly be utilized or adapted for use in at least one possible embodiment may possibly be found in the following U.S. Pat. Nos. 4,189,337, entitled "Real Time Labeler System"; No. 2004/0226659 A1, entitled "Label Application System"; No. 6,191,382 B1, entitled "Dynamic Laser Cutting Apparatus"; No. 2003/0146943 A1, entitled "Label Printer-Cutter with Mutually Exclusive Printing and Cutting Operation"; and No. 2002/0029855 A1, entitled "System for Printing and Applying Tape onto Surfaces"; U.S. Pat. No. 6,634,400, entitled "Labeling machine;" U.S. Pat. No. 6,561,246, entitled "Labeling machine capable of precise attachment of a label to different sizes of containers;" U.S. Pat. No. 6,550,512, entitled "Labeling machine capable of preventing erroneous attachment of labels on containers;" U.S. Pat. No. 6,378,587, entitled "Cylindrical container labeling machine;" U.S. Pat. No. 6,328,086, entitled "Labeling machine;" U.S. Pat. No. 6,315,021, entitled "Labeling machine;" U.S. Pat. No. 6,199,614, entitled "High speed labeling machine having a constant tension driving system;" U.S. Pat. No. 6,167,935, entitled "Labeling machine"; U.S. Pat. No. 6,066,223, entitled "Labeling machine and method"; U.S. Pat. No. 6,050,319, entitled "Non-round container labeling machine and method;" and U.S. Pat. No. 6,045,616, entitled "Adhesive station and labeling machine."

Some examples of computer systems that may possibly be utilized or possibly adapted for use in at least one possible embodiment of the present application may possibly be found in the following U.S. Pat. No. 5,416,480 issued to Roach et al. on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

The patents, patent applications, and patent publication listed above in the preceding 17 paragraphs with the phrase: "All of the patents, patent applications or patent publications, which were cited" and ending with the phrase: " . . . issued to Moshovich on Jun. 6, 2000," are herein incorporated by reference as if set forth in their entirety. The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 051 898.5, filed on Oct. 31, 2006, having inventor Lutz DECKERT, and DE-OS 10 2006 051 898.5 and DE-PS 10 2006 051 898.5, and International Application No. PCT/EP2007/009370, filed on Oct. 29, 2007, having WIPO Publication No. WO 2008/052731 and inventor Lutz DECKERT, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/009370 and German Patent Application 10 2006 051 898.5 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/009370 and DE 10 2006 051 898.5 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 Labeling arrangement
2 Container
3 Label
3.1 Label material
4 Stock roller
5 Cutting arrangement
6 Transfer drum
7 Rotor
8 Conveyer rollers

9 Cutting drum, or vacuum drum
10 Drum element
10.1 Circumferential surface of the drum element 10
11 Knife at vacuum drum 10
12 Counterknife
13 Knife shaft
14 Drum carrier or bearer
15, 16 Upper/lower board or plate member
17 Carrier arrangement
18 Dish-shaped, plate-like carrier element
19 Disc/Distance piece, spacer structure, distance structure, carrier structure being configured to proved a wall or wall surface
19.1, 19.2, 19.3 Sides of the wall-like distance piece 19
20 Drive shaft for vacuum drum 10
21 Drum segment
22 Vacuum canal
23 Vacuum opening
24 Knife bar structure
25 Rotary distributor or vacuum distributor, rotary distributor an vacuum distributor
26 Distributor element, first
26.1 Ring or sealing surface of the distributor element 26
27 Distributor element, second
27.1 Ring or sealing surface of the distributor element 27
27.2 Upper side of the distributor element 27
27*a*, 27*b* Segment or segment of the distributor element 27
28 Spring, compression spring
29 Vacuum canal
29.1 Vacuum connection
30 Opening
31 Nose
32 Recess
33 Connections
34 Gap
35, 36 Canal
37 Chilling, or cooling medium connection
38 Space
39, 40 Chilling or cooling surface

What is claimed is:

1. A labeling device for handling labels in a container labeling machine, said labeling device comprising:

a drum element that is journaled for rotation in a carrier arrangement and that is configured to be powered for rotation about a drum axis;

at least one vacuum channel that is configured in said drum element and opens into a vacuum opening;

a rotary distributor or vacuum distributor for connecting said at least one vacuum channel configured in said drum element with a vacuum source;

said rotary distributor or vacuum distributor comprises at least one first sealing surface at a first distributor element that does not rotate with said drum element, and at least one second sealing surface provided at said drum element for a sealing position against said first sealing surface; and wherein said first distributor element which forms said first sealing surface is made of a first material of construction which has a higher heat conductivity than a second material of which is made said second sealing surface of a portion at said drum element.

2. The labeling device according to claim 1, wherein said first distributor element which comprises said first sealing surface comprises said first material, at least in the region of said first sealing surface.

3. The labeling device according to claim 2, wherein said first distributor element comprising said first sealing surface is made altogether of said first material.

4. The labeling device according to claim 3, wherein said first material is a metallic material.

5. The labeling device according to claim 4, wherein said second material is a plastic, or synthetic material.

6. The labeling device according to claim 5, wherein said first and second sealing surface are configured in each case as at least one of: a ring surface and a cone surface concentrically surrounding the drum axis.

7. The labeling device according to claim 6, wherein said rotary distributor or vacuum distributor is provided at a frontal side, for example, at the lower face side, in the event of use of said drum element.

8. The labeling device according to claim 7, wherein said second sealing surface is formed by a second distributor element made from said second material.

9. The labeling device according to claim 8, wherein said second distributor element is made of at least two parts or segments.

10. The labeling device according to claim 9, wherein said segments are form-locking but releasably connected to one another.

11. The labeling device according to claim 10, wherein said second distributor element is interchangeable and releasable at said drum element.

12. The labeling device according to claim 11, further comprising a chilling device configured to chill at least said first distributor element, at least in the area of said first sealing surface.

13. The labeling device according to claim 12, wherein said chilling device comprises at least one chilling canal through which can be passed a chilling medium comprising at least one of: a chilling medium in gaseous form, a chilling medium in steam form, and a liquid chilling medium.

14. The labeling device according to claim 13, wherein said at least one chilling canal extends at least with a portion also into a space or gap between said drum element and said first distributor element that forms said first sealing surface.

15. The labeling device according to claim 14, wherein said at least one chilling canal also extends at a side that is facing away from said drum element of said first distributor element that forms said first sealing surface.

16. The labeling device according to claim 15, wherein one of (A) and (B):

(A) said labeling device further comprises a spring arrangement configured to press said first sealing surface or, respectively, said first distributor element forming this sealing surface against said second sealing surface; and (B) said labeling device further comprises a spring arrangement configured to press said first sealing surface or, respectively, said first distributor element forming this sealing surface against said second sealing surface, and said vacuum drum comprises a cutting arrangement, in particular for separating of labels from a tape-shaped label material.

17. A vacuum drum arrangement configured to be used in a container labeling machine, said vacuum drum arrangement comprising:

at least one vacuum drum being configured to hold labels on the outer surface thereof and transfer labels;

said at least one vacuum drum comprising:

a drum carrier;

a rotatable drum element being disposed in said drum carrier;

a drive shaft being configured to rotate said rotatable drum element;

said rotatable drum element comprising:

at least one vacuum opening being disposed on the exterior surface of said rotatable drum element;

at least one vacuum channel being connected to said at least one vacuum opening and being disposed in the interior of said rotatable drum element; and a vacuum distribution ring being configured and disposed to connect said at least one vacuum channel to a vacuum source, to thereby connect said at least one vacuum opening to a vacuum source;

said drum carrier comprising a heat sink being disposed adjacent to said rotatable drum element and being stationary with respect to said rotatable drum element;

said rotatable drum element further comprising a first heat-conductive material;

said heat sink comprising a second heat-conductive material;

said second material of said heat sink having a higher heat conductivity than said first heat-conductive material of said rotatable drum element; and said heat sink being configured to draw heat away from said rotatable drum element to thereby cool said rotatable drum element and minimize expansion of the diameter of said rotatable drum element.

18. The vacuum drum arrangement according to claim 17, wherein:

said vacuum distribution ring comprises two interlocking segments;

said vacuum distribution ring comprises a material configured to at least one of: redistrict, inhibit, and minimize the absorption of heat;

said heat sink comprises a canal for the flow of a cooling medium;

said cooling medium comprises at least one of:

a gas coolant; and a liquid coolant; and said vacuum drum comprises a vacuum ring seal being disposed on said vacuum distribution ring adjacent to a heat sink seal being disposed on said heat sink.

19. The vacuum drum arrangement according to claim 18, wherein:

said vacuum distribution ring is configured to be interchangeable at said rotatable drum element;

said canal of said cooling medium is in contact with a portion of said rotatable drum element;

said first distributor element comprising said first sealing surface is made altogether of said first material;

said first material is a metallic material;

said second material is a plastic, or synthetic material;

said canal extends at least with a portion also into a space or gap between said rotatable drum element and said first distributor elements that forms said first sealing surface;

said canal also extends at a side that is facing away from said rotatable drum element of said first distributor element that forms said first sealing surface; and said vacuum drum arrangement comprises a spring arrangement configured to press said first sealing surface or, respectively, said first distributor element forming this sealing surface, against said second sealing surface.

20. A vacuum drum arrangement comprising:

a rotatable drum element;

at least one vacuum channel disposed in said drum element and configured to open into a vacuum opening;

a rotary distributor or vacuum distributor configured to connect said at least one vacuum channel with a vacuum source;

said rotary distributor or vacuum distributor comprising a first distributor element comprising a first sealing surface;

said drum element comprising a second sealing surface disposed in a sealing position against said first sealing surface; and said first distributor element and said first sealing surface are made of a first material which has a higher heat conductivity than a second material of which is made said second sealing surface.

* * * * *